US011848519B2

(12) United States Patent
Miyamura et al.

(10) Patent No.: US 11,848,519 B2
(45) Date of Patent: Dec. 19, 2023

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Tetsuya Miyamura, Mie (JP); Yutaka Kobayashi, Mie (JP); Hiroki Kobayashi, Mie (JP); Pipatthana Phatiwuttipat, Mie (JP); Teruo Hara, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 27 days.

(21) Appl. No.: 17/629,558

(22) PCT Filed: Jul. 17, 2020

(86) PCT No.: PCT/JP2020/027815
§ 371 (c)(1),
(2) Date: Jan. 24, 2022

(87) PCT Pub. No.: WO2021/024756
PCT Pub. Date: Feb. 11, 2021

(65) Prior Publication Data

US 2022/0271473 A1 Aug. 25, 2022

(30) Foreign Application Priority Data

Aug. 7, 2019 (JP) ..... 2019-145079

(51) Int. Cl.
*H01R 13/633* (2006.01)
*H01R 13/426* (2006.01)
*H01R 13/627* (2006.01)

(52) U.S. Cl.
CPC ..... *H01R 13/633* (2013.01); *H01R 13/426* (2013.01); *H01R 13/6272* (2013.01)

(58) Field of Classification Search
CPC . H01R 13/633; H01R 13/426; H01R 13/6272
(Continued)

(56) References Cited

U.S. PATENT DOCUMENTS 7,275,951 B2 * 10/2007 Shigeta ..... H01R 13/7032 439/352
7,575,463 B2 * 8/2009 Mase ..... H01R 13/631 439/352

(Continued)

FOREIGN PATENT DOCUMENTS

JP 2001-217041 A 8/2001
JP 2013-214437 A 10/2013
JP 2019-087391 A 6/2019

OTHER PUBLICATIONS

International Search Report dated Sep. 24, 2020 for WO 2021/024756 A1 (4 pages).

*Primary Examiner* — Alexander Gilman
(74) *Attorney, Agent, or Firm* — Venjuris, P.C.

(57) ABSTRACT

It is aimed to reduce cost. A female connector (F) includes a female housing (30) to be connected to a male housing (10), a lock functioning portion (57) provided on the female housing (30) and configured to lock the female housing (30) and the male housing (10) in a connected state by being locked to the male housing (10), and a releasing member (63) attachable to and detachable to the female housing (30), the releasing member being a component separate from the female housing (30). The releasing member (63) can dis-
(Continued)

place the lock functioning portion (57) to disengage the lock functioning portion (57) from the male housing (10) while being mounted on the female housing (30).

12 Claims, 12 Drawing Sheets

(58) Field of Classification Search
USPC ..... 439/155
See application file for complete search history.

(56) References Cited

U.S. PATENT DOCUMENTS

| | | | | |
|---|---|---|---|---|
| 7,828,583 | B2 * | 11/2010 | Ohsumi | H01R 13/629 439/374 |
| 8,882,528 | B2 * | 11/2014 | Sasho | H01R 13/6272 439/358 |
| 2006/0194469 | A1 * | 8/2006 | Miyakawa | H01R 13/6272 439/357 |
| 2018/0287295 | A1 * | 10/2018 | Yao | H01R 13/6272 |
| 2018/0301823 | A1 * | 10/2018 | Riku | H01R 13/6271 |
| 2018/0301824 | A1 * | 10/2018 | Riku | H01R 13/633 |
| 2018/0375252 | A1 * | 12/2018 | Suda | H01R 13/6272 |
| 2019/0020148 | A1 * | 1/2019 | Huang | H05K 7/14 |
| 2019/0258012 | A1 * | 8/2019 | Hino | G02B 6/4292 |
| 2019/0273332 | A1 * | 9/2019 | Youtsey | H01R 13/639 |

* cited by examiner

CONNECTOR

CROSS REFERENCE TO RELATED APPLICATIONS

This application is a national phase of PCT application No. PCT/JP2020/027815, filed on 17 Jul. 2020, which claims priority from Japanese patent application No. 2019-145079, filed on 7 Aug. 2019, all of which are incorporated herein by reference.

TECHNICAL FIELD

The present disclosure relates to a connector.

BACKGROUND

Patent literature 1 discloses a connector formed with a lock arm on an outer surface of a housing. With this connector connected to a mating connector, a locking projection of the lock arm is locked to a locking portion of the mating connector, whereby the both connectors are locked in a connected state. In separating the both connectors in the connected state, an unlocking portion (coupling portion) of the lock arm is pressed with a finger, whereby the lock arm is resiliently deformed to disengage the locking projection from the locking portion. By this operation, a locked state by the lock arm is released, wherefore the both connectors can be separated.

PRIOR ART DOCUMENT

Patent Document

Patent Document 1: JP 2019-087391 A

SUMMARY OF THE INVENTION

Problems to be Solved

With the above connector, since the both connectors can be unlocked only by pressing the unlocking portion with a finger without using any jig, operability in unlocking is good. Thus, this connector is useful when the connector is frequently separated after being connected to the mating connector. However, if the connector is not separated frequently, the unlocking portion is not effectively utilized. As a countermeasure against this, it is considered to prepare a housing formed with an unlocking portion and a housing not formed with the unlocking portion and use these two types of housings according to how often the connectors are separated. However, if the two types of housings are manufactured, there is a problem of increasing mold cost.

A connector of the present disclosure was completed on the basis of the above situation and aims to reduce cost.

Means to Solve the Problem

The present disclosure is directed to a connector with a housing to be connected to a mating housing, a lock functioning portion provided on the housing, the lock functioning portion locking the housing and the mating housing in a connected state by being locked to the mating housing, and a releasing member attachable to and detachable from the housing, the releasing member being a component separate from the housing, the releasing member being capable of displacing the lock functioning portion to disengage the lock functioning portion from the mating housing while being mounted on the housing.

Effect of the Invention

According to the present disclosure, it is possible to reduce cost.

DETAILED DESCRIPTION TO EXECUTE THE INVENTION

Description of Embodiments of Present Disclosure

Figure 1:
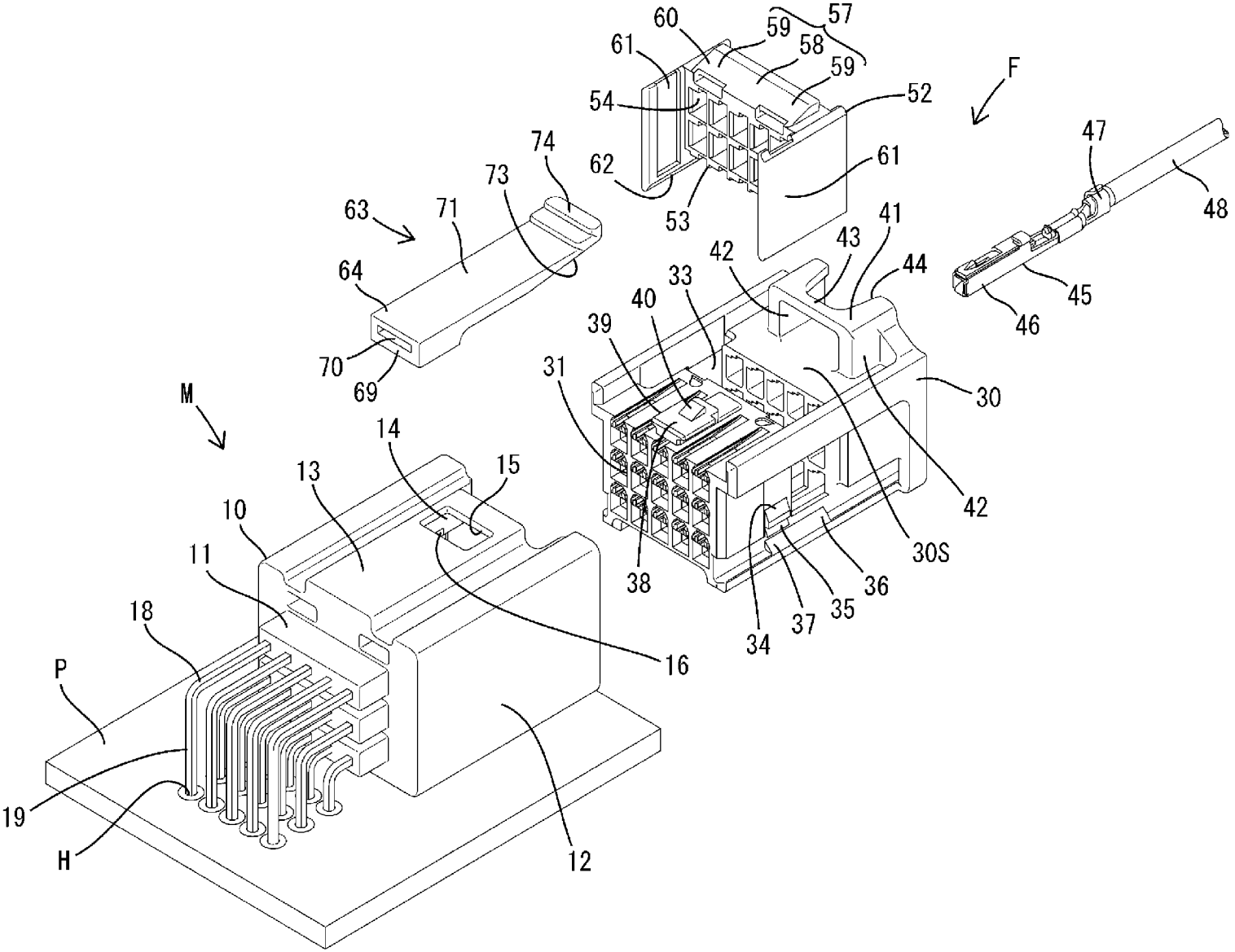
FIG. 1 is an exploded perspective view showing a separated state of a female connector (connector) from a male connector in one embodiment when viewed obliquely from an upper front side.

First, embodiments of the present disclosure are listed and described.

(1) The connector of the present disclosure includes a housing to be connected to a mating housing, a lock functioning portion provided on the housing, the lock functioning portion locking the housing and the mating housing in a connected state by being locked to the mating housing, and a releasing member attachable to and detachable from the housing, the releasing member being a component separate from the housing, the releasing member being capable of displacing the lock functioning portion to disengage the lock functioning portion from the mating housing while being mounted on the housing.

According to the configuration of the present disclosure, in separating the housing and the mating housing in the connected state, the lock functioning portion is displaced to be disengaged from the mating housing by operating the releasing member mounted on the housing. Since whether or not the releasing member is mounted on the housing can be selected according to how often the housings are separated, it is sufficient to prepare only one type of the housing. According to the present disclosure, mold cost can be reduced as compared to the case where two types of housings are manufactured.

(2) Preferably, the releasing member includes a mounting portion to be mounted on the housing and an arm portion cantilevered from the mounting portion, the arm portion coming into contact with the lock functioning portion, and an extending end part of the arm portion serves as an operating portion for displacing the lock functioning portion. According to this configuration, the lock functioning portion can be disengaged from the mating housing only by applying a small operation force to the operating portion by the action of leverage.

(3) Preferably, the lock functioning portion is formed on a movable member separate from the housing, and the movable member is displaceable between a locking position where the lock functioning portion is caused to project from an outer surface of the housing and locked to the mating housing and a releasing position where the movable member is retracted more inwardly of the housing than at the locking position to disengage the lock functioning portion from the mating housing. According to this configuration, the shape of the housing can be simplified and, consequently, the mold cost of the housing can be reduced as compared to the case where the lock functioning portion is integrally formed to the housing.

(4) Preferably, the releasing member is mounted to face the outer surface of the housing while covering a part of the lock functioning portion. According to this configuration, if the releasing member is pushed toward the outer surface of the housing, the movable member can be displaced toward the releasing position and the lock functioning portion can be disengaged from the mating housing.

(5) Preferably, the lock functioning portion has a shape elongated in a width direction intersecting a connecting direction of the housing to the mating housing, and the releasing member covers only a central part in the width direction of the lock functioning portion. According to this configuration, a dimension of the releasing member in the width direction can be reduced. Further, since the releasing member comes into contact with the widthwise central part of the lock functioning portion at the time of an unlocking operation, the movable member can be displaced toward the releasing position without being inclined.

(6) Preferably, the movable member is formed with a retaining portion for retaining a terminal fitting inserted into the housing when the movable member is at the locking position. According to this configuration, the movable member has both a function to lock the housing and the mating housing in the connected state and a function as a retainer to retain the terminal fitting. Therefore, the number of components can be reduced as compared to the case where a retainer is provided separately from the movable member.

(7) Preferably, the movable member is displaceable to a partial locking position where the terminal fitting is allowed to be inserted into the housing, and the releasing member is formed with an interfering portion for restricting mounting of the releasing member on the housing by interfering with the movable member when the movable member is at the partial locking position. According to this configuration, at which of the partial locking position and the locking position the movable member is located can be detected based on whether or not the releasing member can be mounted on the housing.

(8) Preferably, a terminal fitting is inserted into the housing, the terminal fitting includes a resilient contact piece for resiliently contacting a mating terminal mounted in the mating housing, the movable member includes a pressing portion configured to face the resilient contact piece, the resilient contact piece is pressed by the pressing portion to be resiliently deformed away from the mating terminal when the movable member is at the releasing position, and the resilient contact piece is released from pressing of the pressing portion when the movable member is at the locking position.

According to this configuration, in connecting the terminal fitting and the mating terminal, the movable member is displaced to the releasing position to resiliently displace the resilient contact piece in a direction away from the mating terminal. In this way, it is possible to avoid or reduce connection resistance due to sliding resistance between the mating terminal and the resilient contact piece. If the housing and the mating housing are connected and the movable member is displaced to the locking position, the resilient contact piece released from the pressing of the pressing portion resiliently contacts the mating terminal. Therefore, even if there are many terminal fittings, the mating terminals and the terminal fittings can be connected with a small operation force without using a boosting mechanism by a lever.

(9) Preferably, the movable member is formed with a resilient deflecting portion to be resiliently deformed when the movable member is displaced to the releasing position, and a biasing force in a direction to displace the movable member from the releasing position to the locking position is applied to the movable member by a resilient restoring force of the resilient deflecting portion. According to this configuration, since the movable member is held at the locking position by the resilient restoring force of the resilient deflecting portion, a locked state by the movable member can be maintained even without using another member.

Details of Embodiment of Present Disclosure

Embodiment

A specific embodiment of the present disclosure is described with reference to FIGS. 1 to 12. Note that the present invention is not limited to these illustrations and is intended to be represented by claims and include all changes in the scope of claims and in the meaning and scope of equivalents.

In this embodiment, a left side in FIGS. 4 to 6, 9, 11 and 12 is defined as a front side concerning a front-rear direction. Upper and lower sides shown in FIGS. 1 to 12 are directly defined as upper and lower sides concerning a vertical direction. Left and right sides shown in FIGS. 7, 8 and 10 are directly defined as left and right sides concerning a lateral direction.

A female connector F of this embodiment is connected to a male connector M. As shown in FIG. 1, the male connector M is a so-called board connector including a male housing 10 to be mounted on a surface (upper surface) of a circuit board P and a plurality of male terminal fittings 18 mounted in the male housing 10. The male housing 10 includes a wall-like terminal holding portion 11 through which the male terminal fittings 18 are passed, and a receptacle 12 in the form of a rectangular tube projecting toward the female connector F from the outer peripheral edge of the terminal holding portion 11.

As shown in FIGS. 1 and 7, an escaping recess 14 is formed by recessing an inner surface (lower surface) of an upper wall portion 13 of the receptacle 12. The escaping recess 14 is disposed in a laterally central part and extends in the front-rear direction from the tip (opening end) to the back end of the receptacle 12. An operation hole 15 penetrating through the upper wall portion 13 is formed in a region of the upper wall portion 13 where the escaping recess 14 is formed. The operation hole 15 is disposed at a position slightly behind the tip of the receptacle 12.

Figure 6:
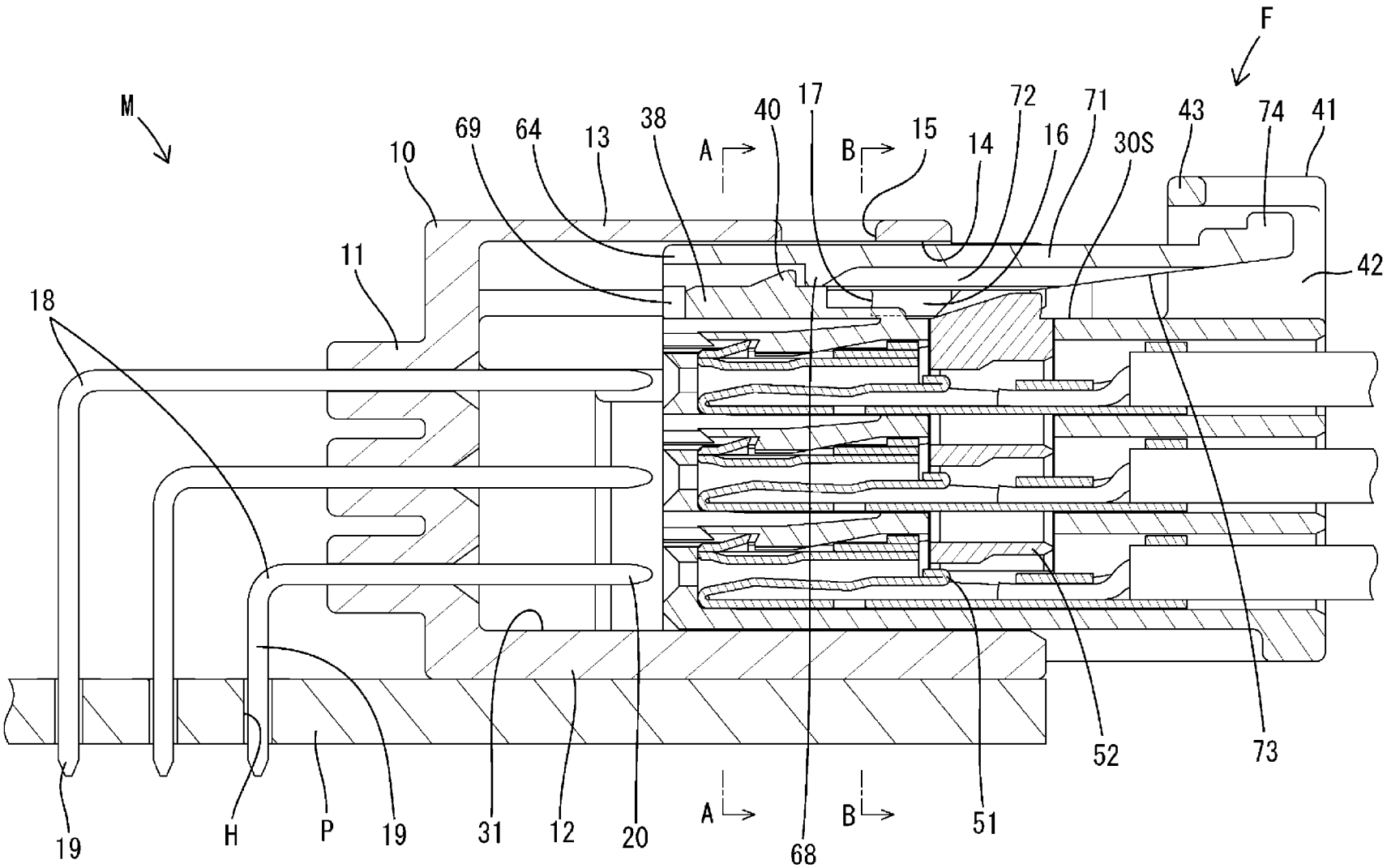
FIG. 6 is a side view in section showing a state where the female terminal fittings and male terminal fittings (mating terminals) are not in contact in the process of connecting the female connector and the male connector.
Figure 7:
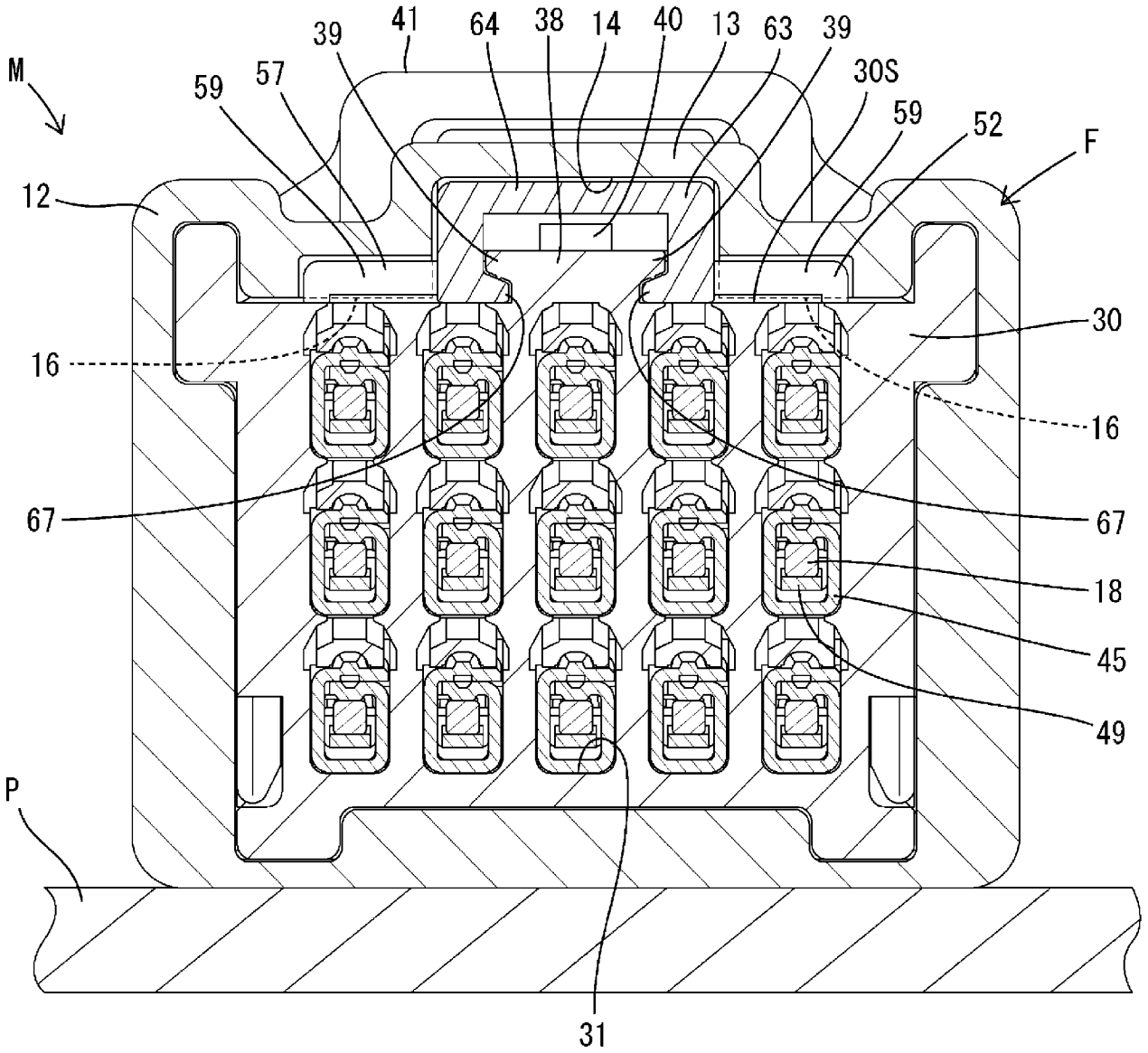
FIG. 7 is a section along A-A of FIG. 6.
Figure 8:
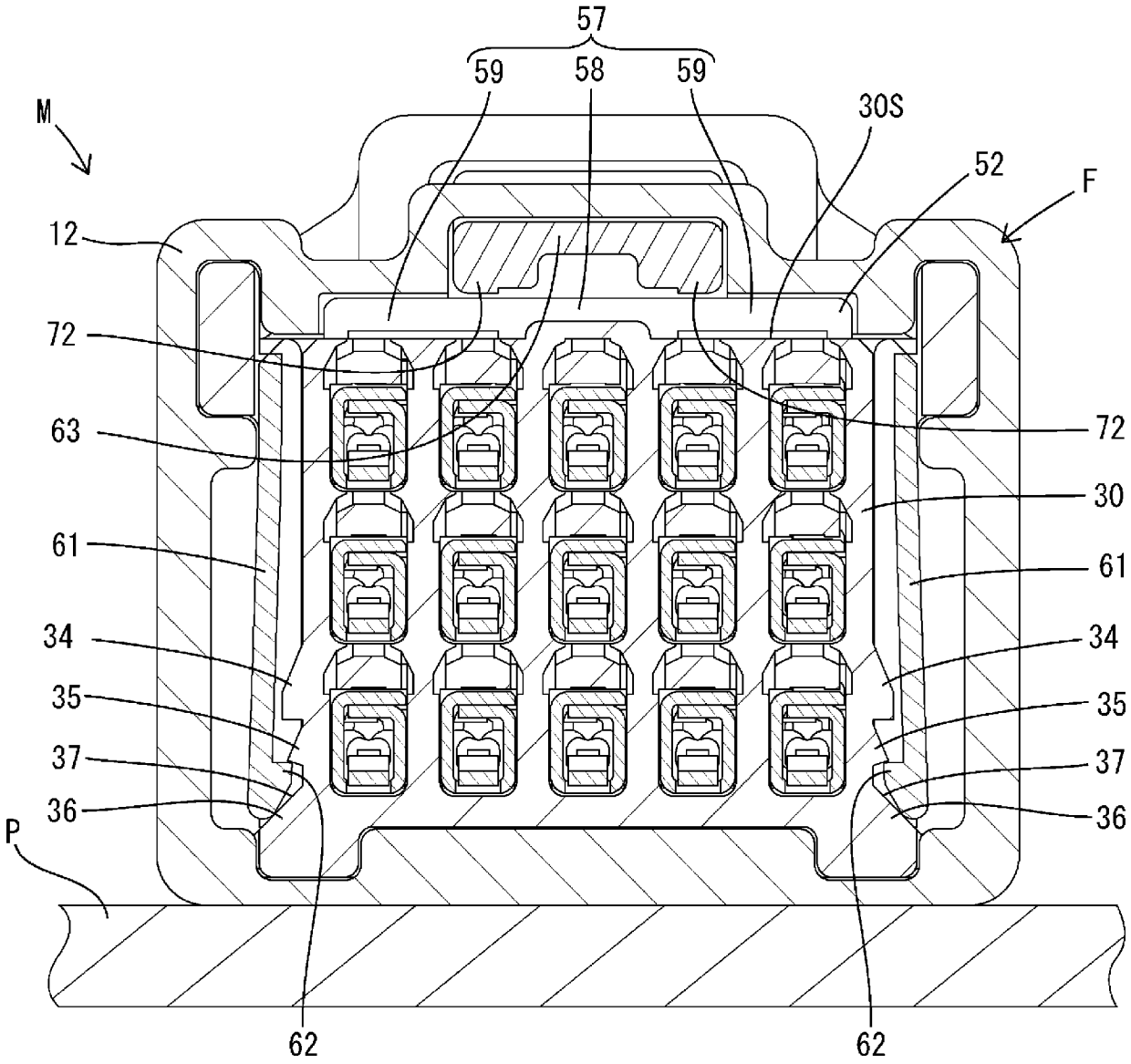
FIG. 8 is a section along B-B of FIG. 6.

As shown in FIGS. 6 and 7, the upper wall portion 13 of the receptacle 12 is formed with a pair of left and right locking portions 16. The pair of locking portions 16 are disposed in parts of the upper wall portion 13 adjacent to both left and right sides of the escaping recess 14 while being spaced apart in the lateral direction. As shown in FIG. 6, the locking portion 16 is disposed on an opening edge part (tip part) of the receptacle 12 in the front-rear direction and has a locking surface 17 facing toward the back side of the receptacle 12. In a side view of the receptacle 12, the locking portion 16 is disposed in front of (opening end side of the receptacle 12) and adjacent to the operation hole 15. The pair of locking portions 16 are disposed at a position lower than the lower surface of the escaping recess 14 in the vertical direction.

As shown in FIGS. 1 and 6, the male terminal fitting 18 is formed by bending an elongated metal bar into an L shape. A board connecting portion 19 of the male terminal fitting 18 is exposed to the outside of the terminal holding portion 11 and connected to the circuit board P while being inserted into a through hole H. A tab 20 of the male terminal fitting 18 projects into the receptacle 12 from the terminal holding portion 11 and is connected to a female terminal fitting 45 to be described later.

Figure 2:
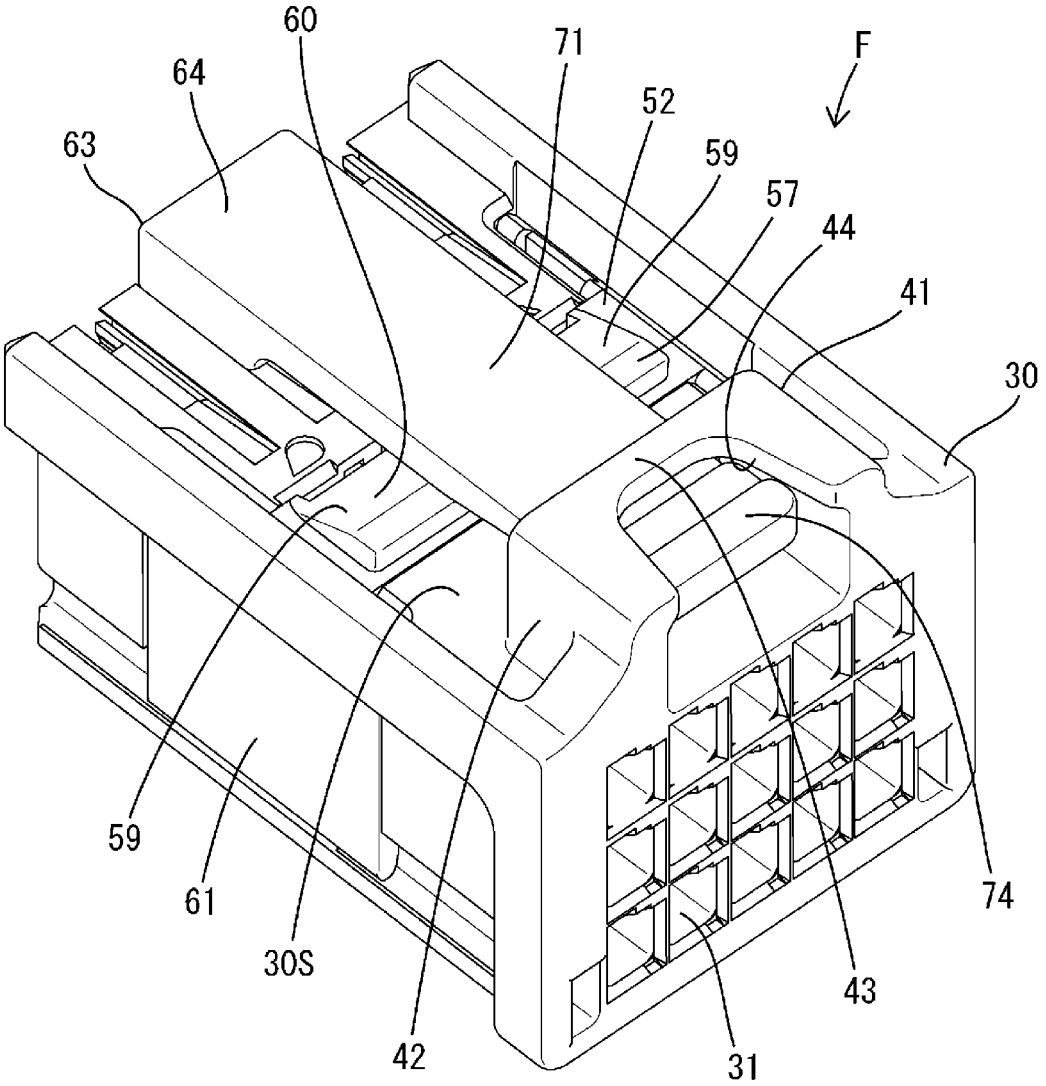
FIG. 2 is a perspective view showing a state where a movable member and a releasing member are mounted on a female housing (housing) when viewed obliquely from an upper rear side.
Figure 4:
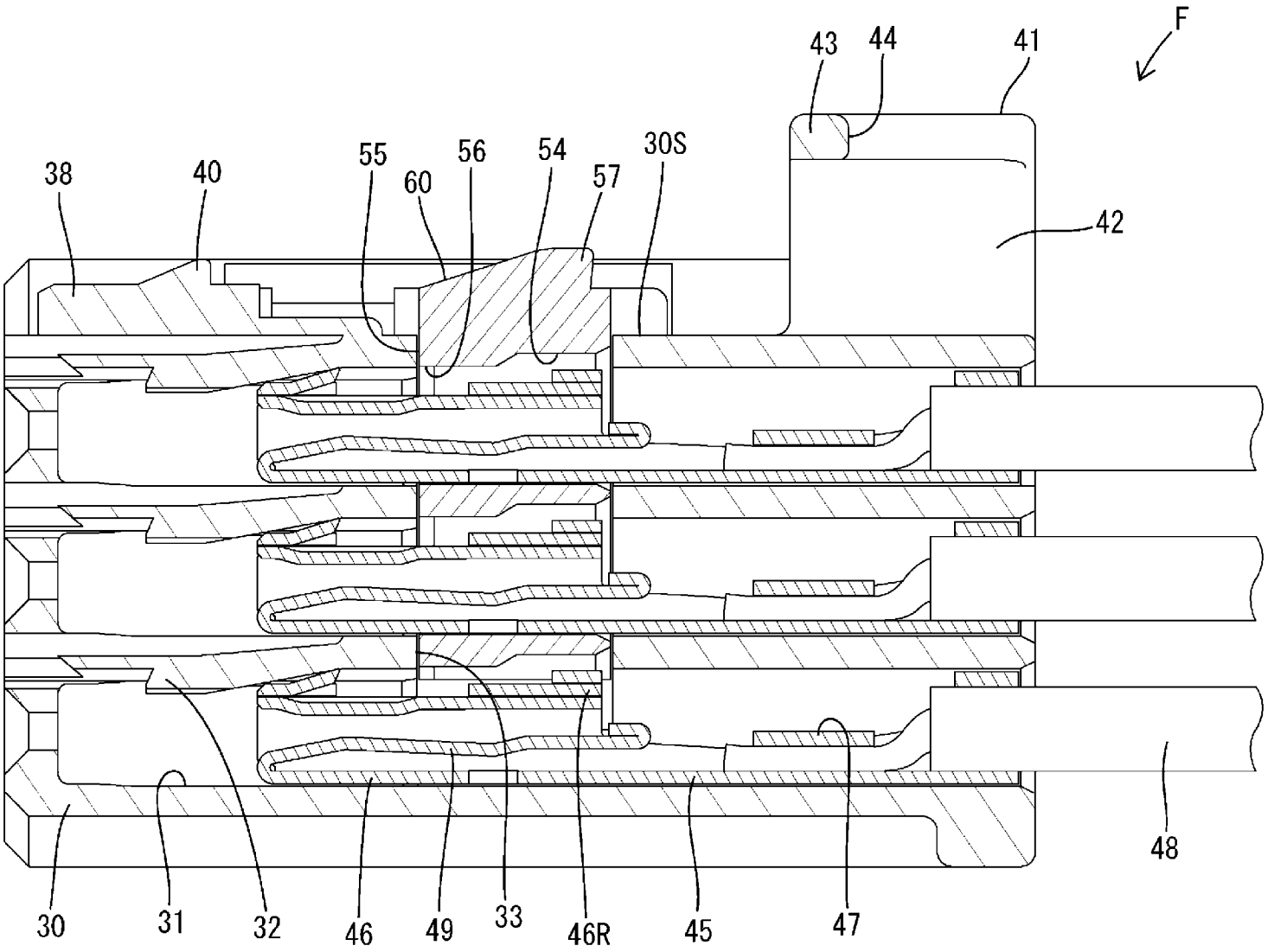
FIG. 4 is a side view in section showing a state where the movable member is mounted at a partial locking position with respect to the female housing (housing) and female terminal fittings (terminal fittings) are inserted in the female housing.

The female connector F includes a female housing 30 made of synthetic resin, a plurality of the female terminal fittings 45, a movable member 52 made of synthetic resin and a releasing member 63. As shown in FIGS. 1 and 2, the female housing 30 is in the form of a block as a whole. In connecting the both connectors F, M, the female housing 30 is accommodated into the receptacle 12. As shown in FIG. 4, a plurality of terminal accommodation chambers 31 penetrating through the female housing 30 in the front-rear direction are formed in the female housing 30. The plurality of terminal accommodation chambers 31 are aligned and arranged in the vertical direction and lateral direction. A resiliently deformable locking lance 32 is formed in a front end part of the terminal accommodation chamber 31.

The female housing 30 includes an accommodation space 33. As shown in FIG. 1, the accommodation space 33 is open in an outer surface 30S (upper surface) and both left and right side surfaces of the female housing 30 and communicates with all the terminal accommodation chambers 31. The accommodation space 33 is disposed in a central part (position behind the locking lances 32) of the female housing 30 in the front-rear direction (direction orthogonal to an inserting/withdrawing direction of the female terminal fittings 45 into and from the female housing 30).

As shown in FIGS. 1, 8 and 10, a pair of left and right partial locking portions 34 and a pair of left and right full locking portions 35 are formed on both left and right outer side surfaces of the female housing 30. The partial locking portions 34 and the full locking portions 35 are disposed in front of the accommodation space 33. The full locking portions 35 are disposed below the partial locking portions 34. The partial locking portions 34 function to hold the movable member 52 at a partial locking position. The full locking portions 35 function to hold the movable member 52 at a locking position.

A pair of left and right expanded portions 36 are formed on the both left and right side surfaces of the female housing 30. The expanded portions 36 are disposed at positions below the full locking portions 35. The expanded portion 36 is shaped to be elongated in the front-rear direction from a front end side region of the accommodation space 33 to a region in front of the accommodation space 33. A front end side part of the expanded portion 36 is disposed in the same region as the partial locking portion 34 and the full locking portion 35 in the front-rear direction. A side surface of the expanded portion 36 serves as an expansion surface 37 oblique to the vertical direction in a front view of the female housing 37. The expansion surface 37 is inclined away from the outer side surface of the female housing 30 toward a lower side.

As shown in FIGS. 1, 4 and 7, a pedestal portion 38 on which the movable member 52 is mounted is integrally formed on the outer surface 30S of the female housing 30. The pedestal portion 38 is disposed in a front end part of the female housing 30 in the front-rear direction and in a central part of the female housing 30 in the lateral direction (width direction). A pair of left and right guide portions 39 extending in the front-rear direction and projecting like ribs are formed on both left and right side edge parts of the pedestal portion 38. A retaining projection 40 is formed on the upper surface of the pedestal portion 38.

As shown in FIGS. 1 and 4, a protecting portion 41 is formed on the outer surface 30S of the female housing 30. The protecting portion 41 includes a pair of bilaterally symmetrical protection wall portions 42 and a coupling portion 43 disposed in a rear end part of the female housing 30. The protection wall portions 42 rise upward from the outer surface 30S of the female housing 30. The coupling portion 43 are elongated in the lateral direction and couples front end parts of upper end edge parts of the both left and right protection wall portions 42. A cut portion 44 is formed in a region behind the coupling portion 43, out of an upper surface part of the protecting portion 41. The cut portion 44 is between the both left and right protection wall portions 42 and open rearwardly of the protecting portion 41.

The female terminal fitting 45 is formed, such as by bending a metal plate material, and has a shape elongated in the front-rear direction as a whole. As shown in FIGS. 1 and 4, a rectangular tube portion 46 is formed in a front end part of the female terminal fitting 45. A crimping portion 47 is formed in a rear end part of the female terminal fitting 45 and crimped to a front end part of a wire 48. The female terminal fitting 45 is inserted into the terminal accommodation chamber 31 from behind the female housing 30 and retained by the locking action of the locking lance 32. With the female terminal fitting 45 inserted at a proper position in the terminal accommodation chamber 31, a rear end edge part 46R of the rectangular tube portion 46 is located in front of and adjacent to the front end of the accommodation space 33.

Figure 11:
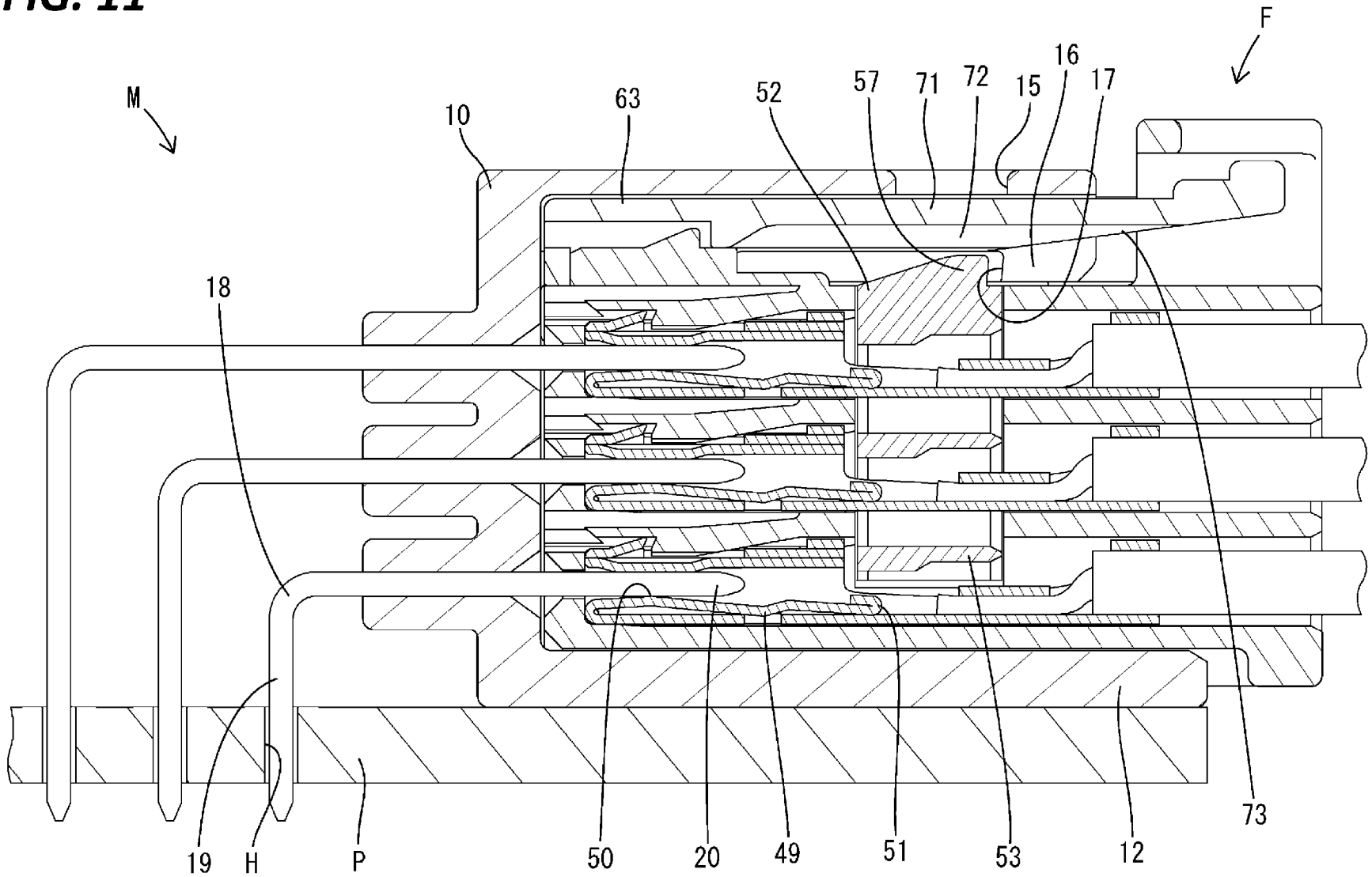
FIG. 11 is a side view in section showing a locked state where the female connector and the male connector are connected and a lock functioning portion is locked to a male housing (mating housing) to restrict the separation of the both connectors.

As shown in FIGS. 4 and 11, the female terminal fitting 45 includes a resilient contact piece 49 for resiliently contacting the tab 20 of the male terminal fitting 18. The resilient contact piece 49 is cantilevered by being folded rearward from the front end of a lower plate part constituting the rectangular tube portion 46. A contact point portion 50 to be brought into point or line contact with the tab 20 is formed at a position slightly behind the front end of the resilient contact piece 49. A rear end part (extending end part) of the resilient contact piece 49 functions as a pressure receiving portion 51. A major region of the resilient contact piece 49 excluding the pressure receiving portion 51 and including the contact point portion 50 is accommodated in the rectangular tube portion 46. The pressure receiving portion 51 projects further rearward than the rear end of the rectangular tube portion 46.

The movable member 52 is a component made of synthetic resin and separate from and independent of the female housing 30. As shown in FIG. 1, the movable member 52 is a bilaterally symmetrical single component including a body portion 53 rectangular in a front view, a lock functioning portion 57 and a pair of resilient deflecting portions 61. The body portion 53 includes a plurality of through holes 54 aligned in the vertical direction and lateral direction. In a front view, the plurality of through holes 54 are aligned and arranged in the vertical direction and lateral direction. This alignment of the through holes 54 is the same as that of the plurality of terminal accommodation chambers 31. As shown in FIG. 4, an upper edge part of each through hole 54, out of the front surface of the body portion 53, functions as a retaining portion 55. A front end part in the upper surface of each through hole 54 functions as a pressing portion 56 facing downward. The pressing portion 56 and the retaining portion 55 are connected at a right angle.

As shown in FIG. 1, the lock functioning portion 57 projects upward from the upper wall portion 13 of the body portion 53 and extends in the lateral direction. A laterally central part of the lock functioning portion 57 functions as a receiving portion 58. Both left and right end parts of the lock functioning portion 57 function as lock portions 59. A pair of the lock portions 59 are disposed to sandwich the receiving portion 58 from both left and right sides. The receiving portion 58 and the pair of lock portions 59 are continuously connected. A guiding surface 60 inclined to be lower toward a front side is formed on the upper surface of the lock functioning portion 57.

As shown in FIG. 1, the pair of resilient deflecting portions 61 are cantilevered forward from the front end edges of both left and right side wall parts of the body portion 53. The pair of resilient deflecting portions 61 are in the form of rectangular plates and can be resiliently deformed to be separated from each other. As shown in FIGS. 1, 8 and 10, a locking edge part 62 projecting from an inner surface (surface facing the mating resilient deflecting portion 61) of the resilient deflecting portion 61 is formed on a lower end edge part of the resilient deflecting portion 61.

The movable member 52 is mounted on the female housing 30 with the body portion 53 accommodated in the accommodation space 33 from above the female housing 30 and the pair of resilient deflecting portions 61 overlapped on the both left and right outer side surfaces of the female housing 30. The movable member 52 is a multi-functional component and exhibits a retainer function, a connection force reducing function and a lock function by being mounted on the female housing 30. The retainer function is a function to detect an inserted state of the female terminal fittings 45 in the female housing 30 (terminal accommodation chambers 31) and retain the female terminal fittings 45 inserted into the female housing 30 (terminal accommodation chambers 31). The connection force reducing function is a function to reduce connection resistance due to friction between the female terminal fittings 45 and the male terminal fittings 18 in the process of connecting the both connectors F, M. The lock function is a function to lock the properly connected both connectors F, M (both housings 10, 30) in a separation restricted state.

Figure 9:
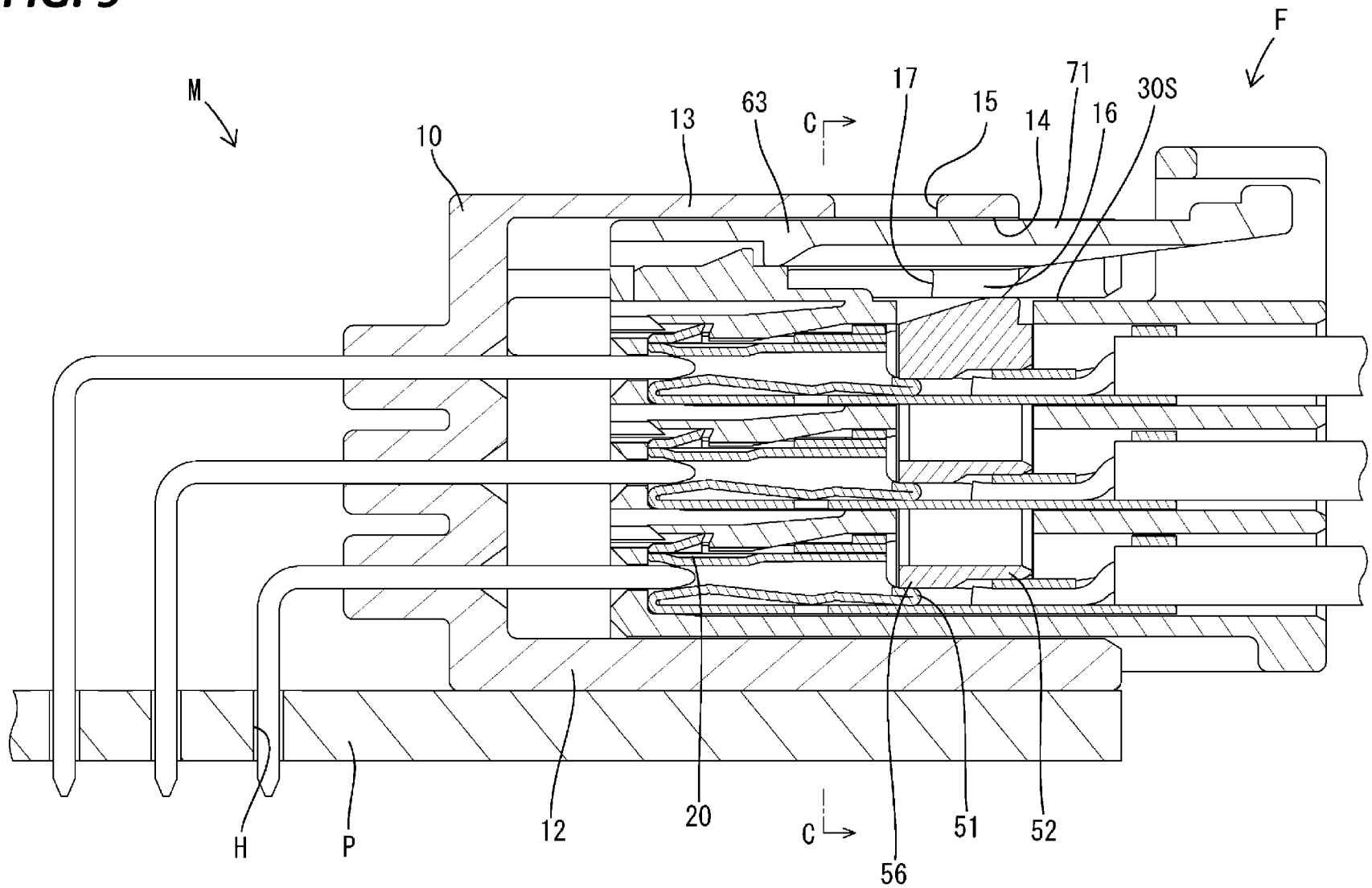
FIG. 9 is a side view in section showing a state where the movable member is displaced to a releasing position and resilient contact pieces of the female terminal fittings are resiliently deformed in a direction away from the male terminal fittings in the process of connecting the female connector and the male connector.
Figure 10:
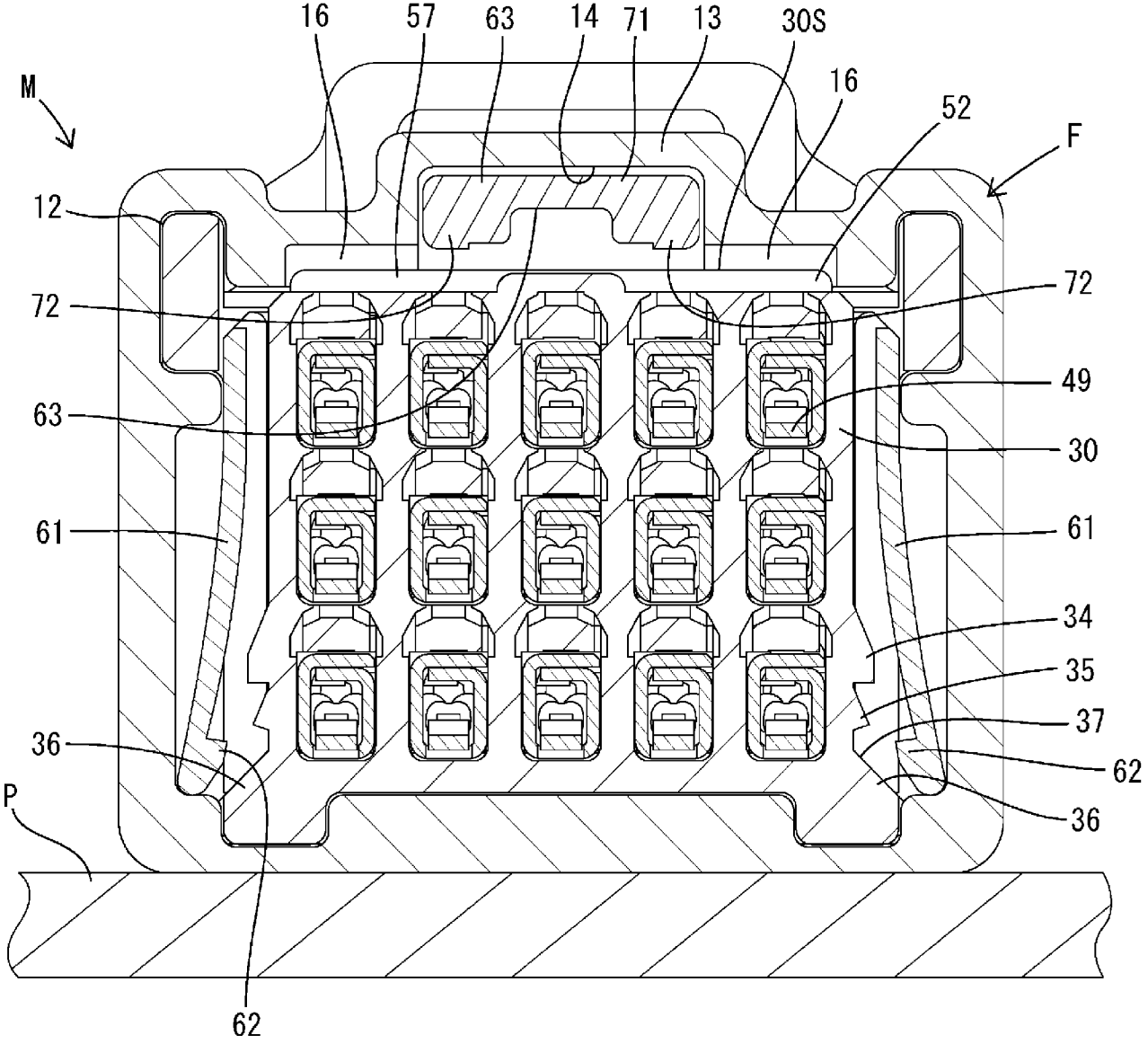
FIG. 10 is a section along C-C of FIG. 9.
Figure 12:
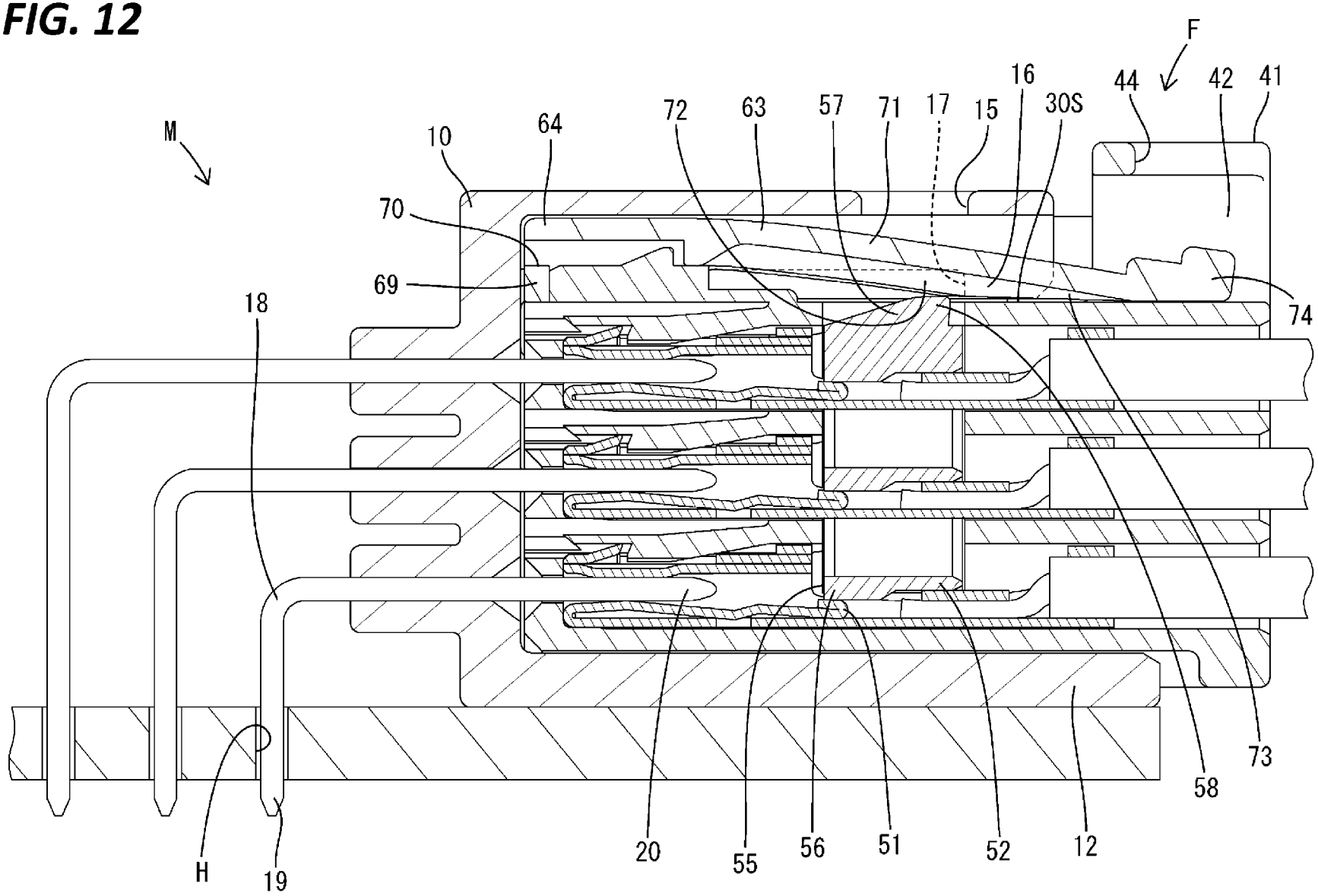
FIG. 12 is a side view in section showing an unlocked state where the lock functioning portion is disengaged from the male housing by operating the releasing member.

The movable member 52 mounted on the female housing 30 is held at three positions including the partial locking position (see FIG. 4), the locking position (see FIGS. 2, 5, 6, 8 and 11) and a releasing position (see FIGS. 9, 10 and 12). The partial locking position is set at a highest position, out of the three positions. The locking edge parts 62 are vertically sandwiched between the partial locking portion 34 and the full locking portion 35, whereby the movable member 52 is held at the partial locking position. The movable member 52 held at the partial locking position is in a state ready to detect the inserted state of the female terminal fittings 45.

The locking position is set at a position lower than the partial locking position and higher than releasing position. As shown in FIG. 8, the locking edge parts 62 are vertically sandwiched between the full locking portion 35 and the expansion surfaces 37, whereby the movable member 52 is held at the locking position. The movable member 52 held at the locking position can exhibit the function to retain the female terminal fittings 45 and the function to lock the both connectors F, M in the connected state.

The releasing position is set at a lowest position, out of the three positions. The movable member 52 at the releasing position loses the function to lock the both connectors F, M in the connected state and exhibits the function to reduce the connection resistance. Further, when the movable member 52 is at the releasing position, lower end parts of the pair of resilient deflecting portions 61 are deformed to be curved outward in the lateral direction (width direction) by the expanded portions 36 as shown in FIG. 10. Thus, resilient restoring forces are accumulated in the resilient deflecting portions 61.

Figure 3:
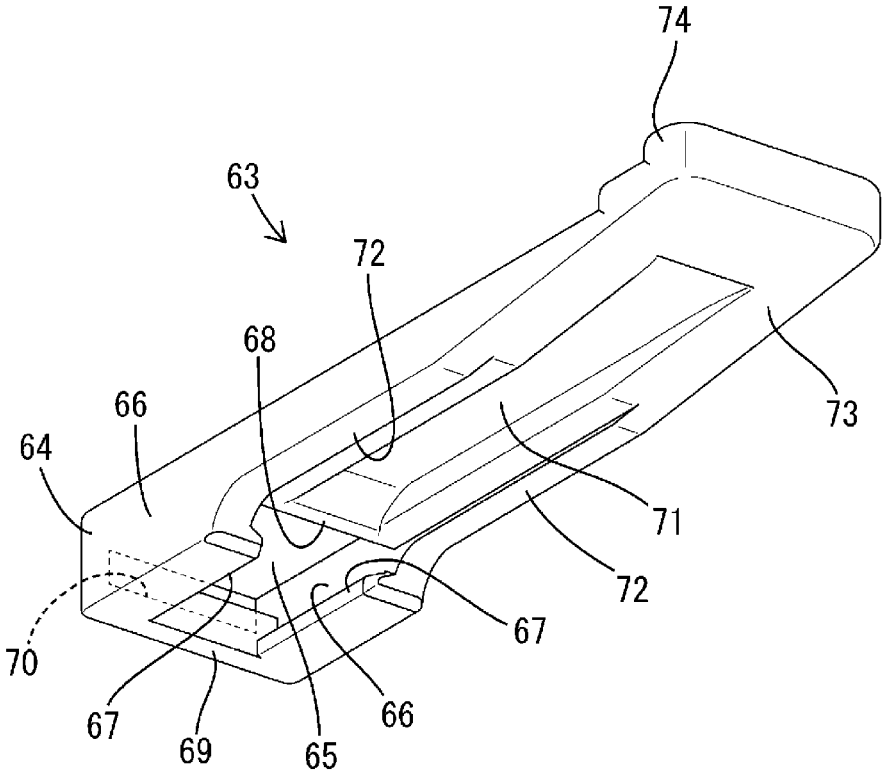
FIG. 3 is a perspective view of the releasing member when viewed obliquely from a lower rear side.

As shown in FIGS. 1 and 3, the releasing member 63 is a component made of synthetic resin and separate from and independent of the female housing 30 and the movable member 52. The releasing member 63 is a component for releasing the locked state of the both connectors F, M (both housings 10, 30) locked in the connected state by the movable member 52. The releasing member 63 is a component in the form of a plate elongated in the front-rear direction as a whole. As shown in FIG. 3, the releasing member 63 includes a mounting portion 63, an arm portion 71 and an operating portion 74 and is bilaterally symmetrically shaped.

The mounting portion 64 is formed in a front end part of the releasing member 63. The mounting portion 64 includes an upper plate portion 65 having a plate thickness direction aligned with the vertical direction, both left and right side plate portions 66, a pair of left and right slide-contact portions 67, a hooking portion 68 and a front-stop portion 69. The both left and right side plate portions 66 extend downward from both left and right side edge parts of the upper plate portion 65. The pair of left and right slide-contact portions 67 are in the form of ribs projecting inward (toward a laterally central side) from the lower end edges of the both left and right side plate portions 66. The hooking portion 68 projects downward from the rear end edge of the upper plate portion 65. The front-stop portion 69 is connected to the front end edge of the upper plate portion 65 and the front end edges of the both left and right side edge parts. A mold removal hole 70 formed in molding the hooking portion 68 is open in the front-stop portion 69.

The arm portion 71 is flush and continuous with the rear end edge of the upper plate portion 65 and is cantilevered rearward from the upper plate portion 65. A pair of left and right contact portions 72 are formed on the lower surface of the arm portion 71. The contact portions 72 project downward from both left and right side edges of the arm portion 71 and extend in the front-rear direction. A formation region of the contact portions 72 in the front-rear direction is a range from the rear ends of the side plate portions 66 of the mounting portion 64 to a central part in the front-rear direction of the arm portion 71.

An interfering portion 73 is formed on the lower surface of the arm portion 71. The interfering portion 73 is formed from the central part in the front-rear direction of the arm portion 71 to the rear end of the arm portion 71. As shown in FIG. 3, a front end side region of the interfering portion 73 is disposed on both left and right side edge parts of the arm portion 71 and connected to the rear ends of the contact portions 72. A rear end part of the interfering portion 73 extends over the entire width of the arm portion 71. As shown in FIG. 6, the lower surface of the interfering portion 73 is inclined to be lower toward a front side.

As shown in FIGS. 1 to 3, the operating portion 74 is formed in a rear end part of the arm portion 71. The operating portion 74 is formed to project in a stepwise manner from the upper surface of the arm portion 71. By projecting in a stepwise manner, a finger placed on the operating portion 74 is less likely to be detached rearward. The operating portion 74 can apply a downward pressing force from above the releasing member 63.

The releasing member 63 can be attached to and detached from the female housing 30, but a necessity to attach the releasing member 63 can be arbitrarily selected according to how often the both connectors F, M are separated. That is, if locking by the movable member 52 is released frequently, the releasing member 63 is mounted on the female housing 30. If locking by the movable member 52 is not released frequently, the both connectors F, M are connected without mounting the releasing member 63 on the female housing 30.

Next, a usage pattern in the case of mounting the releasing member 63 on the female housing 30 is described. First, the movable member 52 is mounted on the female housing 30 and held at the partial locking position. In this state, the heights of the through holes 54 match those of the terminal accommodation chambers 31 and the retaining portions 55 are retracted upwardly of insertion paths into the terminal accommodation chambers 31 for the female terminal fittings 45 as shown in FIG. 4. Thus, the female terminal fittings 45 can be inserted into and withdrawn from the terminal accommodation chambers 31. The female terminal fittings 45 are inserted into the terminal accommodation chambers 31 with the movable member 52 held at the partial locking position.

Figure 5:
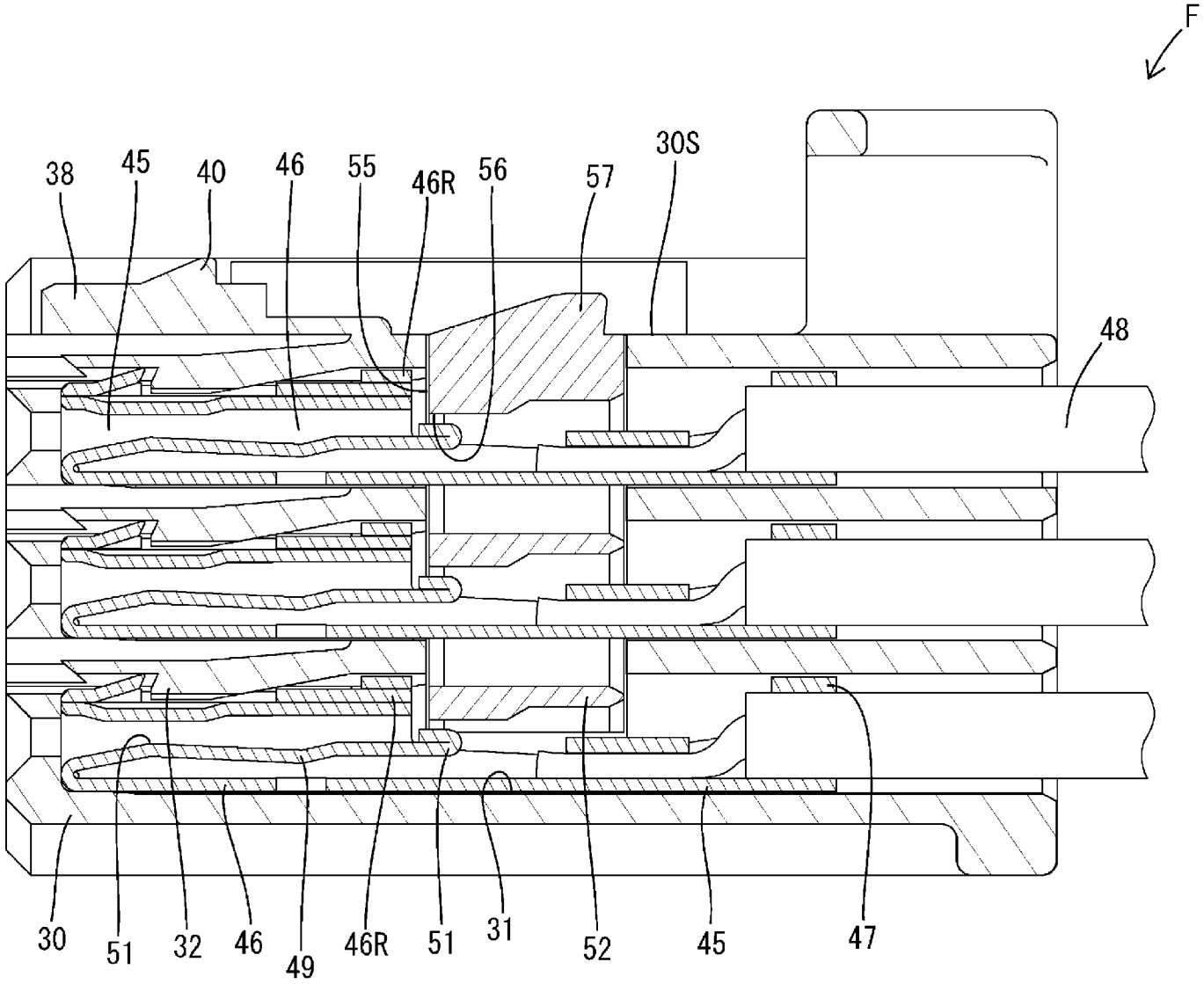
FIG. 5 is a side view in section showing a state where the female terminal fittings are inserted in the female housing and the movable member is displaced to a locking position.

After all the female terminal fittings 45 are inserted, the movable member 52 is pushed down from the partial locking position to the locking position. With the movable member 52 moved to the locking position, the retaining portions 55 enter the insertion paths for the female terminal fittings 45 and proximately face the rear end edge parts 46R of the rectangular tube portions 46 from behind as shown in FIG. 5. Thus, if the female terminal fitting 45 is pulled rearward by an external force or the like acting on the wire 48, the rear end edge part 46R of the rectangular tube portion 46 contacts the retaining portion 55 to be hooked. In this way, the female terminal fitting 45 is restricted from moving rearward and held accommodated in the terminal accommodation chamber 31.

Further, if there is any female terminal fitting 45 not inserted to a proper position when an insertion process of all the female terminal fittings 45 is completed, the pressing portion 56 contacts the upper surface of the rectangular tube portion 46 when an attempt is made to push down the movable member 52 from the partial locking position to the locking position. Thus, the movable member 52 cannot be pushed down to the locking position. Therefore, the inserted state of the female terminal fittings 45 (i.e. whether or not all the female terminal fittings 45 are properly inserted or whether or not there is any incompletely inserted female terminal fitting 45) can be detected based on whether or not the movable member 52 at the partial locking position can be pushed to the locking position.

After the movable member 52 is moved to the locking position, the releasing member 63 is mounted on the female housing 30. In mounting, the mounting portion 64 is brought closer to the pedestal portion 38 from front of the female housing 30 while the pedestal portion 38 is covered from above by the arm portion 71. Then, the hooking portion 68 is caused to slide in contact with the upper surface of the pedestal portion 38 and the side plate portions 66 and the slide-contact portions 67 are caused to slide in contact with the side surfaces and lower surfaces of the guide portions 39. By these sliding contacts, the releasing member 63 is mounted while being kept in a fixed posture with relative displacements with respect to the pedestal portion 38 in the vertical direction and lateral direction restricted.

With the releasing member 63 properly mounted, the hooking portion 68 rides over the retaining projection 40 and comes into contact with the retaining projection 40 from behind and the front-stop portion 69 comes into contact with the pedestal portion 38 from front as shown in FIG. 6. By this contact action, the releasing member 63 is held with a movement with respect to the pedestal portion 38 (female housing 30) in the front-rear direction restricted.

With the releasing member 63 properly mounted, the lower surfaces of the contact portions 72 are proximately facing the receiving portion 58 of the lock functioning portion 57 from above as shown in FIG. 8. As shown in FIG. 2, the pair of left and right lock portions 59 are exposed upward on both left and right sides of the releasing member 63. As shown in FIG. 6, the operating portion 74 is accommodated in the protecting portion 41, sandwiched between the both left and right protection wall portions 42 and located below the coupling portion 43. In this way, the interference of external matters with the operating portion 74 from above and from both lateral sides is prevented. Further, since the cut portion 44 is formed in the upper surface part of the protecting portion 41, it is possible to insert a finger between the both left and right protection wall portions 42 and press the operating portion 74 from above with that finger.

Further, if an attempt is made to mount the releasing member 63 on the pedestal portion 38 with the movable member 52 left at the partial locking position, the hooking portion 68 contacts the upper surface of the pedestal portion 38, the side plate portions 66 and the slide-contact portions 67 contact the side surfaces and lower surfaces of the guide portions 39, and the lower surface of the interfering portion 73 of the releasing member 63 interferes with the receiving portion 58 (lock functioning portion 57) immediately after the releasing member 63 is held in a certain mounting posture. If the releasing member 63 is further assembled in this state, friction resistance between the inclined lower surface of the interfering portion 73 and the receiving portion 58 increases. Thus, assembling resistance increases. Therefore, it becomes difficult to proceed with the assembling of the releasing member 63.

Further, if the releasing member 63 is forcibly further assembled in a state where the friction resistance between the interfering portion 73 and the receiving portion 58 is increasing, the hooking portion 68 butts against the retaining projection 40, wherefore the assembling resistance increases at once. Thus, even if the releasing member 63 is forcibly further assembled, the mounting operation of the releasing member 63 becomes difficult before reaching a properly assembled state. Therefore, there is no possibility that the releasing member 63 is mounted on the female housing 30 with the movable member 52 left at the partial locking position. Further, whether or not the movable member 52 has moved to the locking position can be detected based on whether or not the releasing member 63 can be mounted.

Note that if the releasing member 63 is forcibly further assembled with a force exceeding the assembling resistance, the movable member 52 at the partial locking position can be pushed down to the locking position by the inclined lower surface of the interfering portion 73. In this case, a considerably large force is necessary, but the movable member 52 can be held at the locking position at the same time as the assembling of the releasing member 63 is completed.

In connecting the female connector F to the male connector M, the female connector F is inserted into the receptacle 12. In an insertion (connection) process, the guiding surface 60 of the lock functioning portion 57 slides in contact with the lower surfaces of the locking portions 16 on both left and right sides of the escaping recess 14, out of the upper wall portion 13, whereby the movable member 52 at the locking position is pushed to the releasing position. If the movable member 52 moves to the releasing position, the pressing portions 56 press the pressure receiving portions 51 downward. Thus, the resilient contact pieces 49 are resiliently displaced downward in the direction away from insertion paths for the tabs 20. Therefore, when the tabs 20 of the male terminal fittings 18 are inserted into the female terminal fittings 45, sliding resistance (friction resistance) between the tabs 20 and the resilient contact pieces 49 is reduced. In this way, connection resistance between the both connectors F, M is reduced. Note that, in the connection process of the both connectors F, M, the releasing member 63 is accommodated into the escaping recess 14, wherefore the releasing member 63 is neither deformed nor displaced by contacting the receptacle 12.

Further, in the process of moving the movable member 52 to the releasing position, the locking edge parts 62 of the resilient deflecting portions 61 slide in contact with the expanded portions 36 as shown in FIG. 10, thereby being resiliently deformed to be more separated from each other. Since resilient restoring forces are accumulated in the resilient deflecting portions 61 in this way, the movable member 52 is going to move toward the locking position. Further, a return force toward the locking position is applied to the movable member 52 also by resilient restoring forces of the resilient contact pieces 49.

When the both connectors F, M reach a properly connected state, the lock portions 59 (lock functioning portion 57) pass through the locking portions 16. Thus, the movable member 52 resiliently returns from the releasing position to the locking position. When the movable member 52 returns to the locking position, the lock functioning portion 57 is displaced to project from the outer surface 30S of the female housing 30 and the both left and right lock portions 59 are locked to the locking surfaces 17 of the both left and right locking portions 16. By locking the lock portions 59 to the locking portions 16, the both connectors F, M are locked in a separation restricted state. Further, since the pressing portions 56 are disengaged from the pressure receiving portions 51 when the movable member 52 moves to the locking position, the resilient contact pieces 49 resiliently return in a direction toward the tabs 20 and the tabs 20 and the resilient contact pieces 49 are connected with a desired contact pressure. The releasing member 63 does not move from the start to the end of the connection of the both connectors F, M.

In separating the both connectors F, M in the connected state, the operating portion 74 of the releasing member 63 is pushed to displace the arm portion 71 toward the outer surface 30S of the female housing 30. At this time, the releasing member 63 is resiliently deformed. By pushing the operating portion 74, the contact portions 72 of the releasing member 63 press the receiving portion 58. Thus, the movable member 52 at the locking position is pushed down to the releasing position. When the movable member 52 moves to the releasing position, the lock functioning portion 57 is accommodated into the female housing 30 (accommodation space 33) and the lock portions 59 are disengaged from the locking portions 16 (locking surfaces 17). Since the locked state by the lock portions 59 is released in this way, the both connectors F, M (both housings 10, 30) may be pulled apart with an unlocked state maintained.

If the movable member 52 moves to the releasing position by pushing the operating portion 74, the pressing portions 56 press the pressure receiving portions 51. Thus, the resilient contact pieces 49 are displaced in the direction away from the tabs 20. In this way, the sliding resistance between the resilient contact pieces 49 and the tabs 20 is reduced, wherefore resistance at the time of separating the both connectors F, M is also reduced. Since the resilient deflecting portions 61 are resiliently deflected if the movable member 52 moves to the releasing position, a force for returning the movable member 52 to the locking position is accumulated in the movable member 52. Therefore, after the both connectors F, M are separated, the movable member 52 returns to the locking position by resilient restoring forces of the resilient deflecting portions 61 if the finger is released from the operating portion 74. In the above way, the separation of the both connectors F, M is completed.

Next, a usage pattern in which the releasing member 63 is not mounted on the female housing 30 is used. The connection process of the both connectors F, M is not described since it is the same as in the case of mounting the releasing member 63 on the female housing 30. With the both connectors F, M properly connected, the receiving portion 58 of the lock functioning portion 57 can be visually confirmed through the operation hole 15 from above (outside) the receptacle 12. In other words, the receiving portion 58 is exposed to the outside of the receptacle 12 via the operation hole 15.

Accordingly, in separating the both connectors F, M in the connected state, the receiving portion 58 may be pushed down by inserting a jig, tool (not shown) or finger through the operation hole 15 to push the movable member 52 from the locking position to the releasing position. By pushing the movable member 52 to the releasing position, the locked state is released. Since an action when the movable member 52 moves to the releasing position is the same as that when the movable member 52 is moved to the releasing position using the releasing member 63, this is not described. Thereafter, the both connectors F, M (both housings 10, 30) are separated with the jig, tool or finger kept pushing the movable member 52 to the releasing position. After the separation, the separation of the both connectors F, M is completed if the jig, tool or finger is released from the movable member 52.

The female connector F of this embodiment includes the female housing 30 to be connected to the male housing 10, the lock functioning portion 57 provided on the female housing 30, and the releasing member 63. The lock functioning portion 57 locks the female housing 30 and the male housing 10 in the connected state by being locked to the male housing 10. The releasing member 63 is a component separate from the female housing 30 and attachable to and detachable from the female housing 30. The releasing member 63 can displace the lock functioning portion 57 to disengage the lock functioning portion 5 from the male housing 10 while being mounted on the female housing 30.

In separating the female housing 30 and the male housing 10 in the connected state, the lock functioning portion 57 is displaced to be disengaged from the male housing 10 by operating the releasing member 63 mounted on the female housing 30. Since whether or not the releasing member 63 is mounted on the female housing 30 can be selected according to how often the connectors are separated, it is sufficient to prepare only one type of the female housing 30. Therefore, according to the female connector F of this embodiment, mold cost can be reduced as compared to the case where two types of female housings 30 are manufactured.

The releasing member 63 includes the mounting portion 64 to be mounted on the female housing 30 and the arm portion 71 cantilevered from the mounting portion 64 and configured to come into contact with the lock functioning portion 57. The extending end part of the arm portion 71 serves as the operating portion 74 for displacing the lock functioning portion 57 in an unlocking direction. If the operating portion 74 is operated, the arm portion 71 is displaced to be inclined with the mounting portion 64 as a fulcrum and pushes the lock functioning portion 57. A part of the arm portion 71 for coming into contact with the lock functioning portion 57 is closer to the mounting portion 64 than the operating portion 74. Therefore, only by applying a small operation force to the operating portion 74, the lock functioning portion 57 can be moved and disengaged from the male housing 10 by the action of leverage.

The lock functioning portion 57 is formed on the movable member 52 separate from the female housing 30. The movable member 52 is displaceable between the locking position and the releasing position retracted inwardly (into the accommodation space 33) of the female housing 30 from the locking position. With the movable member 52 located at the locking position, the lock functioning portion 57 projects from the outer surface 30S of the female housing 30 and is locked to the male housing 10. With the movable member 52 located at the releasing position, the lock functioning portion 57 is disengaged from the male housing 10. Since the lock functioning portion 57 is formed on the movable member 52 separate from the female housing 30, the shape of the female housing 30 can be simplified as compared to the case where the lock functioning portion 57 is integrally formed to the female housing 30. In this way, mold cost for the female housing 30 can be reduced.

The releasing member 63 is mounted to face the outer surface 30S of the female housing 30 while covering a part (only the receiving portion 58 in a lateral center) of the lock functioning portion 57. Therefore, if the releasing member 63 is pushed toward the outer surface 30S of the female housing 30, the lock functioning portion 57 can be disengaged from the male housing 10 by displacing the movable member 52 toward the releasing position.

The lock functioning portion 57 is shaped to be elongated in the width direction (lateral direction) intersecting a connecting direction of the female housing 30 to the male housing 10, and the releasing member 63 is formed to cover only a widthwise central part (receiving portion 58) of the lock functioning portion 57. According to this configuration, a dimension of the releasing member 63 in the width direction can be reduced. Further, since the releasing member 63 comes into contact with the widthwise central part of the lock functioning portion 57 at the time of an unlocking operation, the movable member 52 can be displaced toward the releasing position without being inclined.

The movable member 52 is formed with the retaining portions 55. The retaining portions 55 retain the female terminal fittings 45 inserted into the female housing 30 when the movable member 52 is at the locking position. That is, the movable member 52 also has the function as a retainer to retain the female terminal fittings 45 in addition to the function to lock the female housing 30 and the male housing 10 in the connected state. Therefore, the number of components of the female housing F of this embodiment can be reduced as compared to the case where a retainer is provided separately from the movable member 52.

The movable member 52 is displaceable to the partial locking position where the insertion of the female terminal fittings 45 into the female housing 30 is allowed. The releasing member 63 is formed with the interfering portion 73 for restricting the mounting of the releasing member 63 on the female housing 30 by interfering with the movable member 52 when the movable member 52 is at the partial locking position. According to this configuration, at which of the partial locking position and the locking position the movable member 52 is located can be detected based on whether or not the releasing member 63 can be mounted on the female housing 30.

The female terminal fittings 45 are inserted into the female housing 30. The female terminal fitting 45 includes the resilient contact piece 49 for resiliently contacting the male terminal fitting 18 mounted in the male housing 10. The movable member 52 includes the pressing portions 56 configured to face the resilient contact pieces 49. When the movable member 52 is at the releasing position, the resilient contact pieces 49 are pressed by the pressing portions 56, thereby being resiliently displaced in the direction away from the tabs 20 of the male terminal fittings 18. When the movable member 52 is at the locking position, the resilient contact pieces 49 are released from the pressing of the pressing portions 56.

According to this configuration, in connecting the female terminal fittings 45 and the male terminal fittings 18, the movable member 52 is displaced to the releasing position to resiliently displace the resilient contact pieces 49 in the direction away from the male terminal fittings 18. In this way, it is possible to avoid or reduce the connection resistance due to the sliding resistance between the male terminal fittings 18 and the resilient contact pieces 49. If the female housing 30 and the male housing 10 are connected and the movable member 52 is displaced to the locking position, the resilient contact pieces 49 released from the pressing of the pressing portions 56 resiliently contact the male terminal fittings 18. Therefore, even if there are many female terminal fittings 45, the male terminal fittings 18 and the female terminal fittings 45 can be connected with a small operation force without using a boosting mechanism by a lever.

The movable member 52 is formed with the resilient deflecting portions 61 to be resiliently deformed when the movable member 52 is displaced to the releasing position. A biasing force in a direction to displace the movable member 52 from the releasing position to the locking position is applied to the movable member 52 by resilient restoring forces of the resilient deflecting portions 61. According to this configuration, since the movable member 52 is held at the locking position by the resilient restoring forces of the resilient deflecting portions 61, the locked state by the movable member 52 can be maintained even without using another member.

Other Embodiments

The present invention is not limited to the above described and illustrated embodiment and is represented by claims. The present invention is intended to include all changes in the scope of claims and in the meaning and scope of equivalents and also include the following embodiments.

Although locking by the lock functioning portion is released by bringing the releasing member toward the outer surface of the housing in the above embodiment, a displacing direction of the releasing member at the time of unlocking may be a direction parallel to the surface of the housing.

Although the releasing member is pushed at the time of the unlocking operation in the above embodiment, locking may be released by pulling the releasing member.

Although the releasing member covers only the widthwise central part of the lock functioning portion in the above embodiment, the releasing member may cover both widthwise end parts of the lock functioning portion. In this case, the widthwise central part of the lock functioning portion is locked to the mating housing.

Although the releasing member is cantilevered rearward in the above embodiment, the releasing member may be cantilevered forward or laterally.

Although the releasing member is mounted on the housing in a cantilever manner in the above embodiment, the releasing member may be mounted on the housing while being supported on both ends.

Although the mounting portion of the releasing member is fixed to the housing and the lock functioning portion is disengaged from the mating housing by resiliently deforming the releasing member, the releasing member may be mounted to rotate or swing about an axis with respect to the housing.

Although the interfering portion of the releasing member interferes with the movable member when the movable member is at the partial locking position in the above embodiment, the releasing member may not include the interfering portion. In this case, even if the movable member is at the partial locking position, the releasing member can be mounted on the housing.

Although the movable member additionally has the function as a retainer to retain the terminal fittings in the above embodiment, the movable member may not have the function as a retainer.

Although the lock functioning portion is formed on the movable member separate from the housing in the above embodiment, the lock functioning portion may be integrally formed to the housing.

Although the lock functioning portion is locked to the mating housing by being displaced in the direction to project from the outer surface of the housing in the above embodiment, the lock functioning portion may be locked to the mating housing by being displaced along the outer surface of the housing.

Although the movable member has the function to avoid or reduce the connection resistance due to the sliding resistance between the terminal fittings and the mating terminals in the above embodiment, the movable member may not have the function to avoid or reduce the connection resistance.

LIST OF REFERENCE NUMERALS

10 . . . male housing (mating housing)
11 . . . terminal holding portion
12 . . . receptacle
13 . . . upper wall portion
14 . . . escaping recess
15 . . . operation hole
16 . . . locking portion
17 . . . locking surface
18 . . . male terminal fitting (mating terminal)
19 . . . board connecting portion
20 . . . tab
30 . . . female housing (housing)
30S . . . outer surface of female housing
31 . . . terminal accommodation chamber
32 . . . locking lance
33 . . . accommodation space
34 . . . partial locking portion
35 . . . full locking portion
36 . . . expanded portion
37 . . . expansion surface
38 . . . pedestal portion
39 . . . guide portion
40 . . . retaining projection
41 . . . protecting portion
42 . . . protection wall portion
43 . . . coupling portion
44 . . . cut portion
45 . . . female terminal fitting (terminal fitting)
46 . . . rectangular tube portion
46R . . . rear end edge part of rectangular tube portion
47 . . . crimping portion
48 . . . wire
49 . . . resilient contact piece
50 . . . contact point portion
51 . . . pressure receiving portion
52 . . . movable member
53 . . . body portion
54 . . . through hole
55 . . . retaining portion
56 . . . pressing portion
57 . . . lock functioning portion
58 . . . receiving portion
59 . . . lock portion
60 . . . guiding surface
61 . . . resilient deflecting portion
62 . . . locking edge part
63 . . . releasing member
64 . . . mounting portion
65 . . . upper plate portion
66 . . . side plate portion
67 . . . slide-contact portion
68 . . . hooking portion
69 . . . front-stop portion
70 . . . mold removal hole

71 . . . arm portion
72 . . . contact portion
73 . . . interfering portion
74 . . . operating portion
F . . . female connector (connector)
H . . . through hole
M . . . male connector
P . . . circuit board

What is claimed is:

1. A connector, comprising:

a housing on which a protecting cover is provided, and connected to a mating housing;

a lock functioning portion provided on the housing, the lock functioning portion locking the housing and the mating housing in a connected state by being locked to the mating housing; and a releasing member provided with a step portion protruding upwardly from a rear end of the releasing member, and attachable to and detachable from the housing, the releasing member being a component separate from the housing, and the step portion of the releasing member being accommodated in the protecting cover of the housing, the releasing member being capable of displacing the lock functioning portion to disengage the lock functioning portion from the mating housing while being mounted on the housing.

2. The connector of claim 1, wherein:

the releasing member includes a mounting portion to be mounted on the housing and an arm portion cantilevered from the mounting portion, the arm portion coming into contact with the lock functioning portion, and an extending end part of the arm portion serves as an operating portion for displacing the lock functioning portion.

3. The connector of claim 1, wherein:

the lock functioning portion is formed on a movable member separate from the housing, and the movable member is displaceable between a locking position where the lock functioning portion is caused to project from an outer surface of the housing and locked to the mating housing and a releasing position where the movable member is retracted more inwardly of the housing than at the locking position to disengage the lock functioning portion from the mating housing.

4. The connector of claim 3, wherein the releasing member is mounted to face the outer surface of the housing while covering a part of the lock functioning portion.

5. The connector of claim 4, wherein:

the lock functioning portion has a shape elongated in a width direction intersecting a connecting direction of the housing to the mating housing, and the releasing member covers only a central part in the width direction of the lock functioning portion.

6. The connector of claim 3, wherein the movable member is formed with a retaining portion for retaining a terminal fitting inserted into the housing when the movable member is at the locking position.

7. The connector of claim 6, wherein:

the movable member is displaceable to a partial locking position where the terminal fitting is allowed to be inserted into the housing, and the releasing member is formed with an interfering portion for restricting mounting of the releasing member on the housing by interfering with the movable member when the movable member is at the partial locking position.

8. The connector of claim 3, wherein:

a terminal fitting is inserted into the housing, the terminal fitting includes a resilient contact piece for resiliently contacting a mating terminal mounted in the mating housing, the movable member includes a pressing portion configured to face the resilient contact piece, the resilient contact piece is pressed by the pressing portion to be resiliently deformed away from the mating terminal when the movable member is at the releasing position, and the resilient contact piece is released from pressing of the pressing portion when the movable member is at the locking position.

9. The connector of claim 3, wherein:

the movable member is formed with a resilient deflecting portion to be resiliently deformed when the movable member is displaced to the releasing position, and a biasing force in a direction to displace the movable member from the releasing position to the locking position is applied to the movable member by a resilient restoring force of the resilient deflecting portion.

10. The connector of claim 1, wherein the protecting cover of the housing includes left and right sidewalls and a connecting portion connected between the left and right sidewalls.

11. The connector of claim 10, wherein a notch is provided in the connecting portion to be open in a rear direction of the protecting cover.

12. The connector of claim 11, wherein the step portion of the releasing member is exposed through the notch when the step portion of the releasing member is accommodated in the protecting cover of the housing.

* * * * *